United States Patent [19]

Jeambey

[11] 4,119,824

[45] Oct. 10, 1978

[54] COMBINATION MICROWAVE OVEN AND COOKING UTENSIL

[76] Inventor: Calhoun G. Jeambey, 7013 Palm Dr., Des Moines, Iowa 50322

[21] Appl. No.: 774,779

[22] Filed: Mar. 7, 1977

[51] Int. Cl.[2] ..... H05B 9/06

[52] U.S. Cl. ..... 219/10.55 E; 99/418; 426/243

[58] Field of Search ..... 219/10.55 E, 10.55 F; 99/430, 426, 433, 439, 416, 418; 426/107, 243, 108

[56] References Cited

U.S. PATENT DOCUMENTS 4,039,797 8/1977 Olsen ..... 219/10.55 E

OTHER PUBLICATIONS

Amana Introduction to Radar Range Cooking 1974, Amana (NC.) pp. 41 & 88.

*Primary Examiner*—Arthur T. Grimley
*Attorney, Agent, or Firm*—Zarley, McKee, Thomte, Voorhees & Sease

[57] ABSTRACT

A microwave oven having a microwave emitting source, a means for distributing the emitted microwaves in an arcuate pattern over a supporting surface within the microwave oven, and a cooking utensil comprised of a non-metalic material on the supporting surface; with the cooking utensil having a food cavity means arranged in a substantially circular shape.

6 Claims, 4 Drawing Figures

COMBINATION MICROWAVE OVEN AND COOKING UTENSIL

BACKGROUND OF THE INVENTION

Conventional microwave ovens have a microwave emitting source which discharges microwaves into the oven interior. A microwave diffuser is normally employed to disburse the microwaves within the cooking compartment. The diffuser is normally in the form of a rotating blade which scatters the microwaves, but which also tends to cause them to disburse in a circular or cyclonic pattern. As a result, food placed within the cooking compartment and arranged in a haphazard pattern are subjected to varying intensities of microwave exposure, thus resulting in nonuniform cooking.

It is the principal object of this invention to provide a cooking utensil for such a microwave oven to more efficiently and effectively utilize the microwave disbursing pattern to achieve uniform cooking. More specifically, this invention contemplates the use of a cooking utensil of a circular shape and located in a central position to uniformly achieve maximum exposure to the disbursed microwaves whereby uniform cooking is achieved. These and other objects will be apparent to those skilled in the art.

BRIEF DESCRIPTION OF THE DRAWINGS

The invention consists in the construction, arrangements and combination of the various parts of the device, whereby the objects contemplated are attained as hereinafter more fully set forth, specifically pointed out in the claims, and illustrated in the accompanying drawings in which:

FIG. 2 is taken on line 2 — 2 of FIG. 1;

DESCRIPTION OF THE INVENTION

Figure 1:
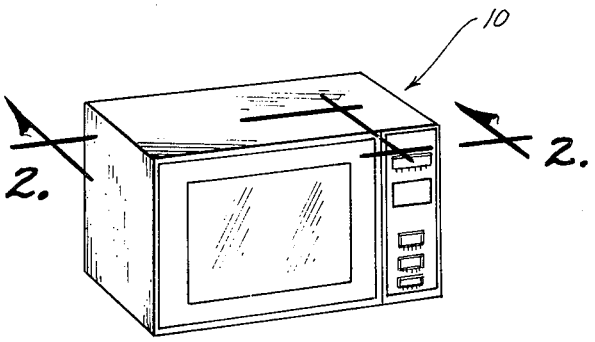
FIG. 1 is a perspective view of a conventional microwave oven.
Figure 2:
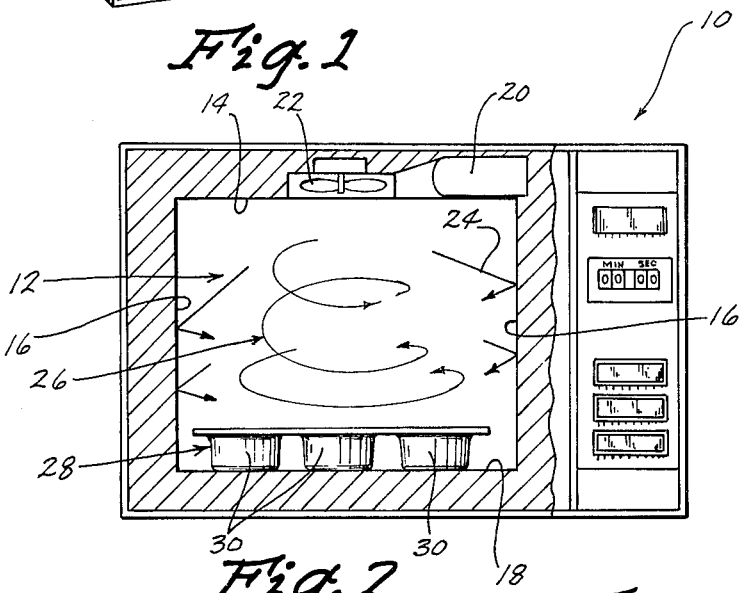
FIG. 2 is an enlarged scale partial sectional view through the oven of FIG. 1 showing the internal construction thereof and showing the location of a cooking utensil therein.
Figure 3:
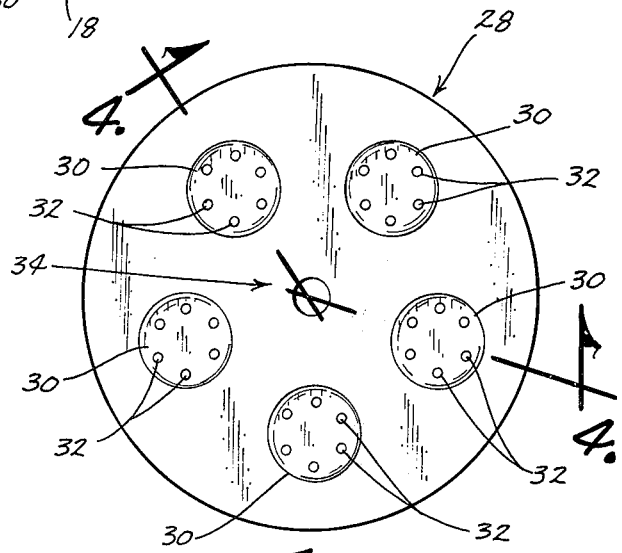
FIG. 3 is a plan view of the cooking utensil shown in FIG. 2.
Figure 4:
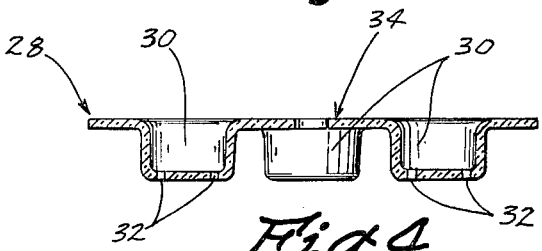
FIG. 4 is a sectional view of the cooking utensil taken on line 4 — 4 of FIG. 3.

The numeral 10 designates a conventional microwave oven having a cooking compartment 12. The compartment 12 as seen in FIG. 2 has a top portion 14, side portion 16, and a bottom supporting portion or surface 18.

The numeral 20 designates a conventional microwave emitting source which is in communication with a diffuser or fan 22. Fan 22 is centrally located in the upper portion 14 of the oven 10. The arrows denominated by the numeral 24 indicate the pattern of some of the diffused or deflected microwaves which are deflected by the fan 22. The numeral 26 illustrates the predominant cyclonic pattern of microwaves which conventionally emit from the diffuser 22. Both the units 20 and 22 are connected to conventional sources of power which are not shown.

A cooking utensil 28 preferably comprised of a nonmetalic inert material that the microwaves will pass through, such as glass, plastic, wood or paper, is centrally located on the bottom surface 18 of the cooking compartment 12 and is symmetrically positioned with respect to the fan 22. This also symmetrically locates the cooking utensil with respect to the cyclonic microwave pattern 26. The cooking utensil 28 is circular in shape and has a plurality of cooking cavities 30 which are also arranged in a circular pattern. The utensil could obviously have a continuous circular shape in the form of an annular groove to provide a donut-shaped cooking cavity. Small apertures 32 appear in the bottom portions of the cavities 30 to vent the food being cooked.

It should be noted that the center portion 34 of the cooking utensil 28 is free from any cooking cavity. This is because the cyclonic microwave pattern 26 creates a microwave "vacuum" in the center portion which inhibits cooking in the center portion. As a result, cooking takes place more rapidly and more efficiently and more uniformly in the peripheral area of the cooking cavities 30 than is the case at the center portion 34.

When the cooking utensil assumes the configuration of utensil 28, and when it is centrally located on the surface 18 with respect to the cyclonic-shaped pattern 26 and the fan 22, uniform and rapid cooking takes place in the peripherally arranged cavities 30. The vents 32 in the bottoms of the cooking cavities permit the moisture from the food being cooked to easily vent. The effect of the disclosed cooking utensil 28 and its location within the oven achieves a rapid and uniform cooking effect.

I claim:

1. The combination of a microwave oven and cooking utensil, comprising, a microwave emitting source in said oven, a cooking utensil supporting surface in said oven, means in said oven for creating relative movement of said emitted microwaves with respect to said supporting surface, a cooking utensil comprised of non-metallic material on said supporting surface, said cooking utensil having a plurality of spaced-apart food cavities formed therein spaced equidistant from the center of said cooking utensil, said food cavities being substantially circular in configuration, said cooking utensil having a center portion which prevents access of food therein.

2. The combination of claim 1 wherein said food cavities have openings in the bottom portion thereof to vent food being cooked therein.

3. The combination of claim 1 wherein said center portion of said cooking utensil comprises a hollow area.

4. The combination of claim 1 wherein said cooking utensil is substantially circular in shape.

5. The combination of a microwave oven and a cooking utensil, comprising, a microwave emitting source in said oven, a cooking utensil supporting surface in said oven, means in said oven for distributing said emitted microwaves in an arcuate pattern over said supporting surface, a cooking utensil comprised of non-metallic material on said supporting surface, a food cavity means in said cooking utensil, said food cavity means being substantially circular in configuration, said food cavity means having a center portion means to prevent the containment of food at the center of said circular configuration, said oven including a top portion and an opposite spaced-apart bottom portion, said means for distributing emitted micro-waves being located in the top portion of said oven, and said cooking utensil being located on said bottom portion directly below said means for distributing said emitted microwaves, said means for distributing said emitted microwaves distributing microwaves in a circular pattern and said cooking utensil is symmetrically positioned with respect to said circular pattern.

6. The device of claim 5 wherein said center portion means comprises a hollow area.

* * * * *